United States Patent [19]

Prange

[11] Patent Number: 4,464,806

[45] Date of Patent: Aug. 14, 1984

[54] SEWER ROD TURNING MACHINE SAFETY DEVICE

[75] Inventor: Charles J. Prange, Cridersville, Ohio

[73] Assignee: Sewer Rodding Equipment Co., Lima, Ohio

[21] Appl. No.: 415,810

[22] Filed: Sep. 8, 1982

[51] Int. Cl.[3] ..... B08B 9/02

[52] U.S. Cl. ..... 15/104.3 SN; 74/495; 200/153 K; 267/150

[58] Field of Search ..... 15/104.3 SN; 200/153 K; 74/495, 543; 267/150; 254/134.3 FT

[56] References Cited

U.S. PATENT DOCUMENTS 3,382,733 5/1968 Miller et al. ..... 200/153 K 3,451,089 6/1969 Carlson et al. ..... 15/104.3 SN

*Primary Examiner*—Edward L. Roberts

*Attorney, Agent, or Firm*—David O'Reilly

[57] ABSTRACT

A sewer rod turning machine safety device for machines which drive sewer cleaning rods. These machines are comprised of a motor driving a transmission which in turn drives a rod coupling drive shaft through a gear box. The motor transmission and gear box are all mounted on a wheeled cart. The rod turning machine has a shift lever attached to the transmission which will rotate the rods in forward or reverse direction. The shift lever has a center neutral position and the forward and reverse rotation positions are to either side of neutral. The safety device is comprised of a spring steel bendable rod engaging the shift lever which is designed to return the shift lever to center neutral position whenever it is released by an operator. A collar and bolt arrangement, securely fastening the safety bar to the gear box and the free end of the safety bar, has a loop wrapping around the shaft of the shift lever when securely mounted.

3 Claims, 3 Drawing Figures

SEWER ROD TURNING MACHINE SAFETY DEVICE

FIELD OF THE INVENTION

This invention is related to machines for driving sewer cleaning rods and more particularly relates to a portable sewer cleaning rod turning machine safety device.

BACKGROUND OF THE INVENTION

Sewer cleaning rod turning machines of the type described herein are comprised of a motor, usually an internal combustion motor such as those used in lawn mowers, which operates a drive shaft through a transmission and gear box. The rod turning machine is connected to the end of a long sewer cleaning rod formed of multiple sections of rods joined end to end, which are pushed into a sewer until they reach an obstruction. The rod turning machine is then started and the shift lever operated to stop or start rotation of the sewer cleaning rods. The shift lever permits clockwise or counter-clockwise rotation and has a central neutral position. The opposite rotational directions are controlled by moving the shift lever to either side of neutral.

When cleaning a sewer pipe using the rod turning machine, two workmen are required. One workman stands at an opening to a sewer to push rods into the sewer pipe, while another workman operates the sewer rod turning machine. A problem with these types of devices is that extreme care must be used to avoid too much slack in the rods and too much torque to be built up in the rods. When too much torque builds up with slack permitted between the entrance to the sewer and the connection of the rods to the rod turning machine, the rods can twist and loop. Permitting this to happen can result in dangerously flailing rods and must be avoided. Therefore, it is imperative that the sewer rod turning machine never be left unattended while the shift lever is in an operational position.

With present rod turning machines the shift lever, when positioned to rotate the sewer rods in either direction, will remain in that position and the operator must physically return the lever to neutral. It would be advantageous if the shift lever would automatically return to neutral except when held in an operational position to the right or left of neutral by the operator.

Therefore, it is one object of the present invention to provide a safety device for returning the shifting lever of a sewer rod turning machine to neutral whenever the operator releases the shift lever and leaves the machine.

Another object of the present invention is to provide a safety device for a sewer rod turning machine which is simple and easy to install on existing rod turning machines.

SUMMARY OF THE INVENTION

The present invention is for a safety device adaptable to portable sewer cleaning rod turning machines for automatically returning the shift lever to neutral whenever released by an operator.

The rod turning machine is comprised of a motor for driving a drive shaft through a transmission and gear box. The transmission is reversible and will drive sewer cleaning rods clockwise or counter-clockwise by moving a shift lever side to side from a central neutral position. A spring steel rod is mounted on the rod turning machine and engages the shift lever. The spring steel rod has a bending moment which automatically returns the shift lever to neutral whenever it is released by the rod turning machine operator.

The spring steel bar for returning the shift lever to neutral is mounted on the gear box and is substantially perpendicular to the shift lever. The end of the spring steel bar, in engagement with the shift lever, is formed in a hook or loop which tightly wraps around the shift lever. When the operator moves the shift lever to either side to drive the sewer cleaning rods in either direction, it can be dangerous if the operator leaves the machine with the shift lever in a drive position. Thus, with the spring steel bar of the present invention, when the operator moves the shift lever to either side the spring steel bar will bend, allowing the operator to easily hold the shift lever in a position for driving the sewer cleaning rods clockwise or counter-clockwise. If the operator releases the shift lever and leaves the machine unattended, the bending moment of the spring steel bar will automatically return the shift lever to a neutral position, stopping the rotation of the sewer cleaning rods.

The spring steel bar is securely attached to the gear box and extends substantially perpendicular to the shift lever. The loop on the end of the bar is constructed to snugly fit around the shift lever and be of sufficient length to prevent the operator from dislodging the shift lever from the loop and defeating the safety device. Thus, the operator may not easily defeat the purpose of the safety bar by attempting to force the safety bar out of the loop formed on the end of the safety bar.

The above objects, advantages and other novel features of the invention will be fully understood from the following detailed description and the accompanying drawings, in which:

DETAILED DESCRIPTION OF THE INVENTION

Figure 1:
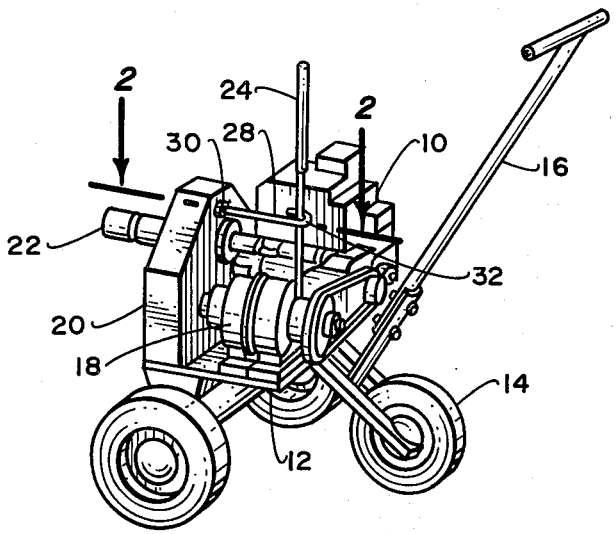
FIG. 1 is a perspective view of a sewer cleaning rod turning machine according to the invention.

A sewer cleaning rod turning machine is shown in FIG. 1 and is comprised of a motor 10 mounted on a portable cart 12 having wheels 14 and a handle 16 for easy portability. The motor 10 drives a transmission 18 which in turn is connected to a gear box 20 for driving a shaft 22 having means for coupling sewer cleaning rods to the sewer rod turning machine.

Figure 2:
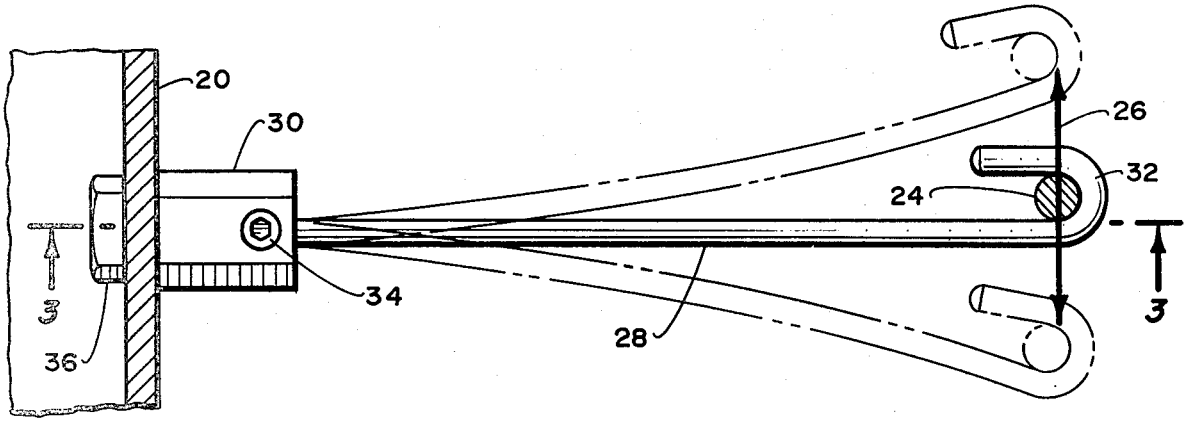
FIG. 2 is a sectional view of the safety bar taken at 2—2 of FIG. 1.
Figure 3:
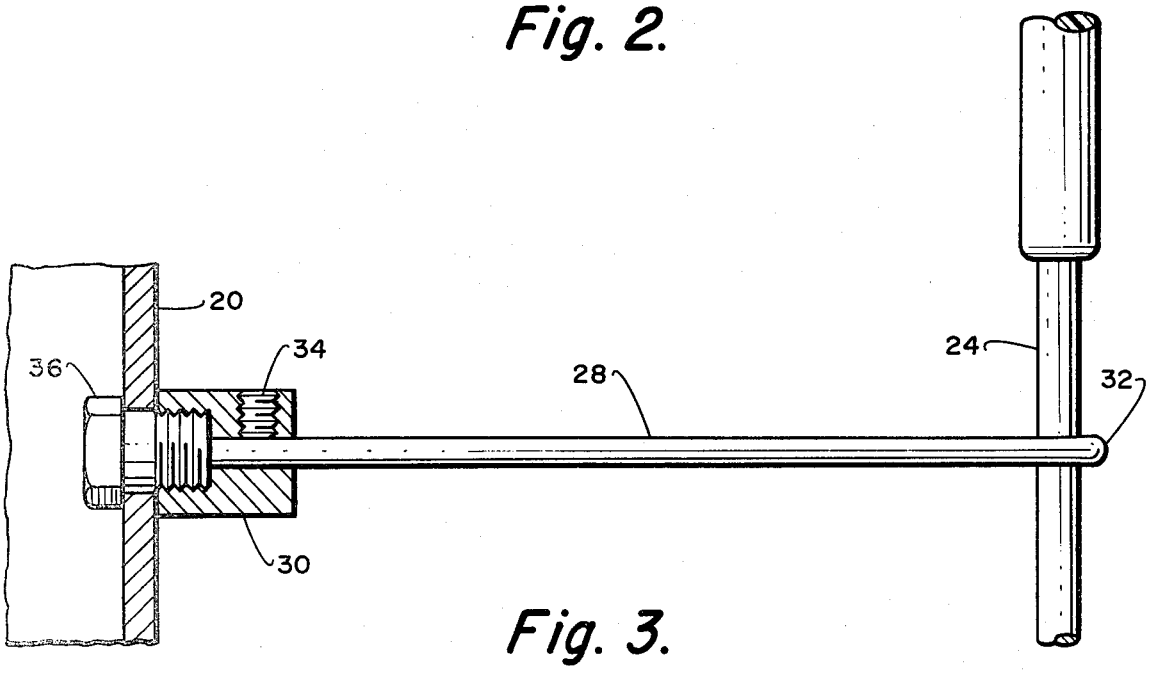
FIG. 3 is a view of the safety bar taken at 3—3 of FIG. 2.

The transmission 18 allows the drive shaft 22 to be driven in a clockwise and counter-clockwise direction by shift lever 24. Generally, the counter-clockwise drive is for intermittent use only, for example to release a stuck sewer cleaning rod having a cleaning tool attached to its end. The shift lever causes a clockwise or counter-clockwise rotation by side to side movement from a center neutral position, as illustrated by the arrow 26 shown in FIG. 2.

In use, sewer cleaning rods, having a cleaning tool attached, are pushed into a sewer pipe by a workman. The sewer cleaning rod is comprised of a string of rods joined by couplings. The workman continues to feed the sewer cleaning rod and add additional rod sections until an obstruction is reached. The end of the sewer cleaning rod is then attached by the means of a coupling (not shown) to the drive shaft 22 of the rod turning machine, which will be many feet from the entrance to the sewer pipe. Another workman will operate the rod turning machine. In using the rod turning machine, extreme care must be used to avoid too much slack in the rods between the entrance into the sewer and the rod turning machine and avoid letting too much torque build up in the rods. If too much slack and torque builds up between the entrance into the sewer and the rod turning machine, the rods can twist and loop, creating a very dangerous situation. The rods, when they twist and loop, can flail around and cause serious injury if a person is struck. Thus, the turning machine operator should never leave the shift lever in a drive position and leave the machine unattended.

To prevent such an occurence, a safety bar has been provided which can easily be attached to any existing rod turning machines, which will automatically return the shift lever to a neutral position. The safety bar 28 is attached to the gear box 20 by a collar 30 and has a hook or loop 32 for engagement with the shift lever 24. The loop 32 wraps around the shift lever 24 and extends a sufficient distance past the lever to prevent the operator from defeating the safety bar by disengaging it from the loop. The other end of the safety bar 28 is fastened by a collar 30 to the wall of the gear box 20. The end of the bar 28 is securely clamped in a collar by a set screw 34. The collar 30 is then fastened to the wall of the gear box 20 by a bolt 36. Thus, the safety bar can easily be adapted to existing sewer cleaning rod turning machines by simply drilling a hole in the wall of the gear box 20, securing the collar 30 by the means of the bolt 26, inserting the rod 28 in the collar 30 and securing by set screw 34 so that loop 32 engages and wraps around the shift lever 24.

Obviously, many modifications and variations of the invention are possible in light of the above teachings. Therefore, the invention is not to be limited by the embodiment shown in the drawings and described in the description, which is given by way of example and not of limitation but only in accordance with the scope of the appended claims.

What is claimed is:

1. In a sewer cleaning rod turning machine device having a motor, a transmission, a gear box and a rod coupling drive shaft, the improvement comprising; shift lever means connected to said transmission for engaging said transmission to turn said sewer cleaning rods in a first direction or in a direction in reverse to said first direction; said shift lever having a neutral position; resilient safety means engaging said shift lever for returning said shift lever to neutral, said resilient safety means comprising a spring steel bar having a bending movement which returns said shift lever to neutral when said shift lever is released.

2. The device according to claim 1 in which said shift lever is a substantially vertical shaft; said shaft having a central neutral position, a first rotational position to one side of neutral and a reverse rotational position to the other side of neutral; said spring steel bar being secured to said gear box at one end and extending outward approximately in perpendicular engagement with said shift lever.

3. The device according to claim 2 in which said bar is formed with a loop on a free end in wrap-around engagement with said shift lever shaft whereby said safety bar may be easily fitted to said sewer cleaning rod turning machines.

* * * * *